US006449444B1

(12) United States Patent
Tanaka

(10) Patent No.: US 6,449,444 B1
(45) Date of Patent: Sep. 10, 2002

(54) IMAGE FORMING APPARATUS CAPABLE OF CHANGING A CHANGING POSITION FROM A TRANSFERRING BIAS TO A LOW BIAS

(75) Inventor: Yuko Tanaka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/648,737

(22) Filed: Aug. 28, 2000

(30) Foreign Application Priority Data

Aug. 31, 1999 (JP) ..... 11-246627

(51) Int. Cl.[7] ..... G03G 15/00
(52) U.S. Cl. ..... 399/66; 399/314; 399/313
(58) Field of Search ..... 399/66, 297, 314, 399/313

(56) References Cited

U.S. PATENT DOCUMENTS 6,070,024 A * 5/2000 Oono ..... 399/66

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

An image forming apparatus includes an image bearing member which bears a toner image, a transferring member which forms the image bearing member and a nip and transfers the toner image onto a transferring material, a bias applying unit for applying a transferring bias to the transferring member, the bias applying unit changing from the transferring bias to a low bias lower than the transferring bias at the rear end portion of the transferring material, and a control unit for controlling a position at which the transferring bias is changed to the low bias.

11 Claims, 12 Drawing Sheets

IMAGE FORMING APPARATUS CAPABLE OF CHANGING A CHANGING POSITION FROM A TRANSFERRING BIAS TO A LOW BIAS

BACKGROUND OF THE INVENTION

1. Field of the Invention

The present invention relates to an image forming apparatus such as a copying machine or a printer which uses an electrophotographic system or an electrostatic recording system.

2. Related Background Art

FIG. 11 shows an image forming apparatus of the electrophotographic system.

In the figure, the image forming apparatus includes a drum-shaped electrophotographic photosensitive member (hereinafter referred to as "photosensitive drum") 1 which rotates in a direction indicated by an arrow a (clockwise). A charging roller 2, an exposing apparatus 3, a developing apparatus 4, a transfer roller 5 and a cleaning apparatus 6 are disposed around the photosensitive drum 1.

Upstream of a transferring nip portion N between the photosensitive drum 1 and the transfer roller 5 in a conveying direction of a transferring material P, a sheet feeding cassette 7, a sheet feeding roller 8, a pre-feed sensor 9, a pair of resist rollers 10, a top sensor 11 and a transfer guide 12 are disposed. On the other hand, downstream of the transferring nip portion N in the conveying direction of the transferring material P, an electricity erasing needle 13, a conveying guide 14, a fixing apparatus 15 and a pair of sheet discharging rollers 16 are disposed.

Also, the image forming apparatus can perform duplex image formation (duplex printing), and a pair of reverse rollers 18, a pair of sheet re-feeding rollers 19 and a sheet re-feeding sensor 20 for duplex image formation are disposed in a duplex conveying path 17.

The photosensitive drum 1 is formed of a negatively charged OPC photosensitive member which is rotationally driven in the direction indicated by the arrow a at a given process speed in a conventional example.

The charging roller 2 is brought in contact with a surface of the photosensitive drum 1 by a predetermined pressing force and charges the photosensitive drum 1 to a predetermind polarity and potential by a charging bias applied from a charging bias power supply (not shown).

The exposing apparatus 3 includes a laser diode that emits a laser beam, a collimator lens, a polygon mirror, an fθ lens, etc., not shown, and scans the photosensitive drum 1, which has been uniformly charged by the charging roller 2, with an outgoing laser beam L, which has been on/off-controlled in accordance with inputted image information, in a direction perpendicular to the rotating direction of the photosensitive drum 1 and then exposes light. The exposure allows charges on a portion of the photosensitive drum 1 which has been scanned with the laser beam L to be removed, and an electrostatic latent image to be formed on the surface of the photosensitive drum 1.

The developing apparatus 4 includes a rotatable developing sleeve 4*a* inside of which a magnet roller (not shown) is fixed. The developing apparatus 4 coats a developer (toner) on a developing sleeve 4*a* into a thin layer and attaches the toner onto the electrostatic latent image formed on the surface of the photosensitive drum 1 at a developing position to develop (visualize) the electrostatic latent image as a toner image. The developing sleeve 4*a* is applied with a developing bias from a developing bias power supply (not shown).

The transfer roller 5 is brought in contact with the surface of the photosensitive drum 1 by a predetermied pressing force to form the transferring nip portion N, and transfers the toner image on the surface of the photosensitive drum 1 onto the transferring material P at the transferring nip portion N defined between the photosensitive drum 1 and the transfer roller 5. The transfer roller 5 is rotated in a direction indicated by an arrow b (counterclockwise).

The fixing apparatus 15 includes a fixing roller 15*a* and a pressure roller 15*b*. The fixing apparatus 15 heats and pressurizes the transferring material P onto which the toner image has been transferred between the fixing roller 15*a* and the pressure roller 15*b* to thermally fix the toner image onto the surface of the transferring material P.

Subsequently, the image forming operation of the above-described image forming apparatus will be described.

Upon the issuance of an image forming operation start signal, the transferring materials P within the cassette 7 are fed one by one by the sheet feeding roller 8 and conveyed up to the pair of resist rollers 10. During this operation, the conveyance of the transferring materials P is detected by the pre-feed sensor 9.

On the other hand, the photosensitive drum 1 is rotationally driven in the direction indicated by the arrow a by driving means (not shown) and charged to the predetermined potential by the charging roller 2. Then, the laser beam L corresponding to an image signal is irradiated onto the photosensitive drum 1 from the exposing apparatus 3, and the potential on the photosensitive drum 1 at a portion onto which the laser beam L has been irradiated drops to form the electrostatic latent image. Then, the toner is attached onto the electrostatic latent image formed on the photosensitive drum 1 by the developing sleeve 4*a* of the developing apparatus 4 to which the developing bias having the same polarity as the charging polarity (negative polarity) of the photosensitive drum 1 is applied, to thereby visualize the electrostatic latent image as the toner image.

Then, after a leading end of the transferring material P is detected by the top sensor 11, the transferring material P is fed by the pair of resist rollers 10 to the transferring nip portion N between the photosensitive drum 1 and the transfer roller 5 through the transfer guide 12 in synchronism with the rotation of the photosensitive drum 1. Then, the transfer roller 5 is applied with a transferring bias having the reverse polarity (positive polarity) of the toner from the transferring bias power supply (not shown), and the toner image is transferred onto the transferring material P from the photosensitive drum 1.

Then, the transferring material P onto which the toner image has been transferred is electricity-erased by the electricity erasing needle 13 to which charges having the reverse polarity (negative polarity) of the transfer roller 5 are given, and the transferring material P is separated from the photosensitive drum 1 by the own weight of the transferring material P. The transferring material P which has been separated from the photosensitive drum 1 is conveyed to the fixing apparatus 15 through the conveying guide 14, and the transferred toner image is thermally fixed onto the surface of the transferring material P due to heating and pressurizing by the fixing roller 15*a* and the pressure roller 12*b* of the fixing apparatus 15. Then, the transferring material P is discharged to the external from the pair of sheet discharging rollers 16.

On the other hand, a residual toner (untransferred toner) and other attachments are removed from the surface of the photosensitive drum 1 from which the toner image has been transferred and cleaned by the cleaning apparatus 6, and the photosensitive drum 1 is put to succeeding image formation.

Also, at the time of duplex image formation (double-sided print), the transferring material P which has been discharged from the fixing apparatus 15 after the image has been formed on a first surface (front surface) of the transferring material P is reversed by the reverse rollers 18 and conveyed to the duplex conveying path 17. Then, the transferring material P is allowed to pass through the sheet re-feeding sensor 20 by the sheet re-feeding rollers 19 and again introduced to the pair of resist rollers 10. Thereafter, another image is formed on a second surface (back surface) of the transferring material P in the same manner as the first surface.

Note that at the time of the above-described image formation, the transfer roller 5 is applied with a transferring bias Vtr required for transferring the toner image from the transferring bias power supply (not shown) to give charges to the transferring material P that passes through the transferring nip portion N between the photosensitive drum 1 and the transfer roller 5 so that the toner image is transferred onto the transferring material P from the photosensitive drum 1. After the toner image has been transferred onto the transferring material P, a voltage applied to the transfer roller 5 is turned off or changed to a low bias Vlow lower than the transferring bias Vtr, to thereby prevent a drum memory or a sheet mark from occurring at the time of non-transferring.

Assuming that an image forming area (printable area) S of the transferring material P is, as shown in FIG. 12, b mm (for example, 5 mm) inside of a leading end P1, a rear end P2, and right and left ends P3, respectively, the changing of the bias from the transferring bias Vtr after transferring to the low bias Vlow is conducted, as shown in FIG. 13, in a non-image area S' inside of the rear end P2 of the transferring material P by a distance c (c<b) mm. In this example, the conveying direction of the transferring material P is a direction indicated by an arrow A.

As described above, in the case of changing the transferring bias, a timing of changing from the transferring bias to the low bias at the rear end P2 of the transferring material P is decided by reckoning a time at which the rear end P2 of the transferring material P reaches the transferring nip portion N from a time at which the rear end P2 of the transferring material P passes through the top sensor 11 upstream of the transferring nip portion N, a distance between the top sensor 11 and the transferring nip portion N, and a conveying speed of the transferring material P backward.

However, the distance between the top sensor 11 and the transferring nip portion N is slightly varied by the respective manufactured image forming apparatuses, and the conveying speed of the transferring material P also depends on the outer diameter of the transfer roller 5, the sort of the transferring material P, the printing ratio, etc., and slightly varies. For that reason, there arises such a problem that a timing of changing from the transferring bias to the low transferring bias is slightly shifted.

Also, the top sensor 11 includes, as shown in FIG. 14, a sensor lever 21 movable by contact with the transferring material P that passes through the sensor lever 21, and a photo-interrupter 22 that detects the moved sensor lever 21 in a non-contact manner, and detects the leading end and the rear end of the transferring material P that passes through the top sensor 11.

However, in the top sensor 11, since the movable range of the sensor lever 21 depends on which portion of the sensor lever 21 the transferring material P passes through, there arises such a problem that an error occurs in a period of time until the photo-interrupter 22 detects the sensor lever 21, to thereby shift the timing of changing the transferring bias.

As described above, if the timing of changing the transferring bias is shifted, for example, in the case where the changing timing is shifted toward the rear end side of the transferring material P, an excessive transferring current flows in the photosensitive drum 1 side at an edge portion of the rear end of the transferring material P. For that reason, the potential fluctuates due to the excessive current that flows at the rear end of the transferring material P on the photosensitive drum 1, as a result of which there occurs a phenomenon that the potential fluctuation appears as a memory or a stripe on the photosensitive drum 1 at the time of printing a next transferring material P (hereinafter referred to as "rear end memory").

On the contrary, in the case where the timing of changing the transferring bias is shifted toward the inside from the rear end of the transferring material P, the timing of changing the transferring bias is applied to the image forming area, and for example, at the time of printing the second surface of the transferring material P (a rear-surface printing at the time of the duplex image formation) or printing a high-resistant transferring material (paper) P, the transferring current is short when the bias is changed to the low transferring bias, thereby leading to such a problem that the toner image scatters.

In particular, the timing of changing the transferring bias is more shifted as the process speed becomes higher, and the high-speed printing operation of the image forming apparatus in recent years makes it difficult to provide latitude to that shift in the non-image area at the rear end of the transferring material P.

SUMMARY OF THE INVENTION

The present invention has been made under the above circumstances, and therefore an object of the present invention is to provide an image forming apparatus which does not allow any memory corresponding to a rear end of a transferring material to occur.

Another object of the present invention is to provide an image forming apparatus which does not allow a toner image on the rear end of the transferring material to scatter.

Still another object of the present invention is to provide an image forming apparatus which is capable of changing a transferring bias at an optimum timing.

Yet still another object of the present invention is to provide an image forming apparatus, comprising:

- an image bearing member which bears a toner image;
- a transferring member which forms the image bearing member and a nip and transfers the toner image onto a transferring material;
- bias applying means for applying a transferring bias to the transferring member, the bias applying means changing from the transferring bias to a low bias lower than the transferring bias at the rear end portion of the transferring material; and
- control means for controlling a position at which the transferring bias is changed to the low bias.

Yet still other objects of the present invention will become apparent from the following description.

These and other objects, features and advantages of this invention will become more fully apparent from the following detailed description taken with the accompanying drawings.

DESCRIPTION OF THE PREFERRED EMBODIMENTS

Figure 11:
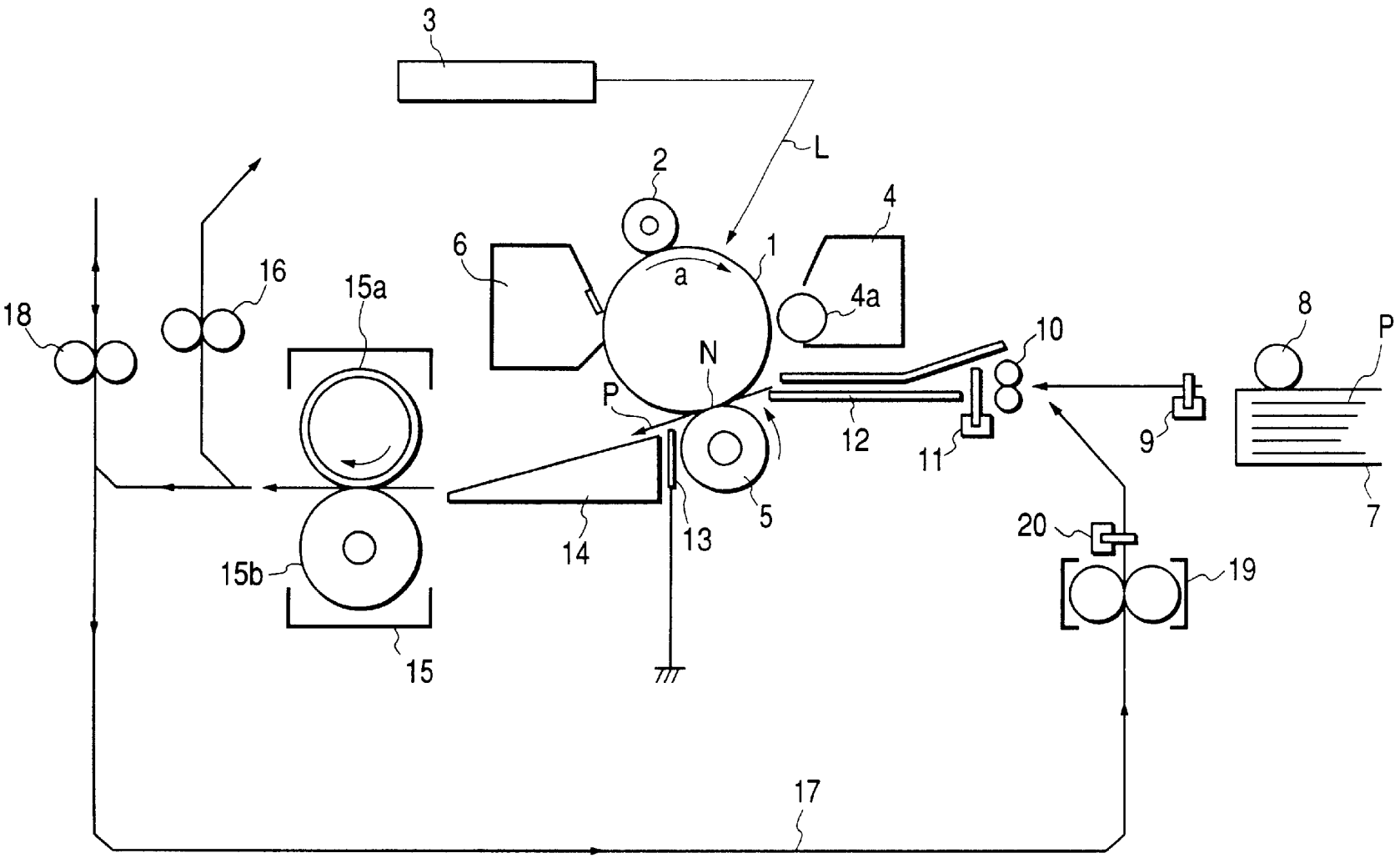
FIG. 11 is a schematic structural diagram showing an image forming apparatus.
Figure 12:
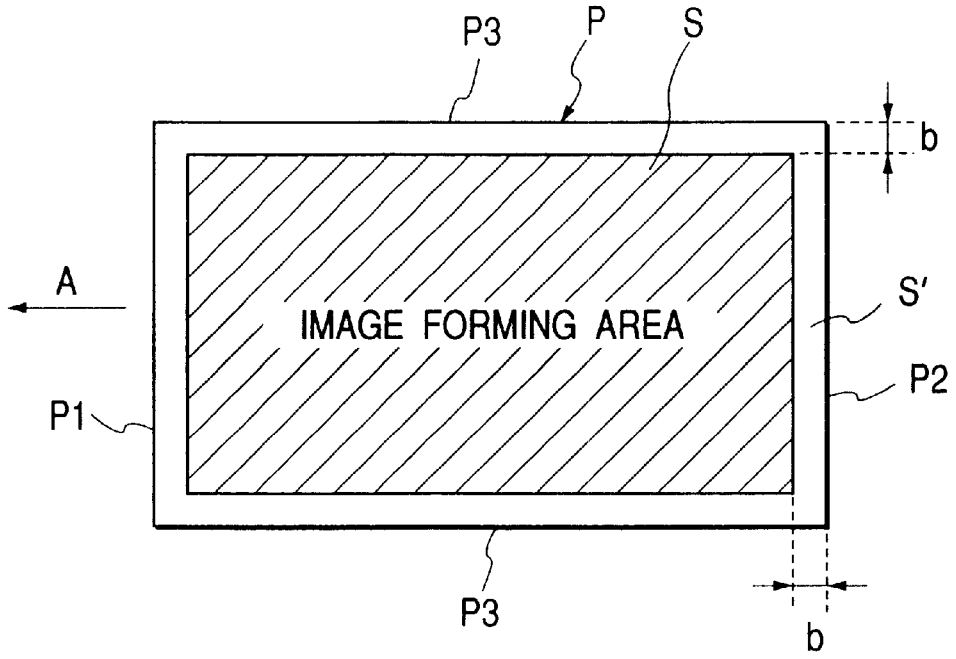
FIG. 12 is a diagram for explanation of an image forming area and margins of the transferring material.
Figure 13:
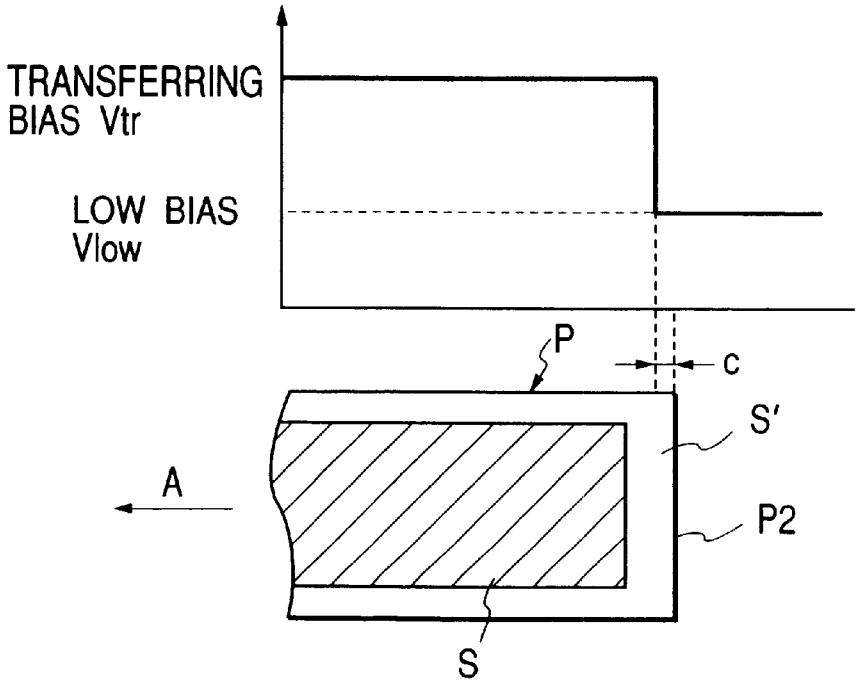
FIG. 13 is a diagram for explanation of the image forming area of the transferring material and a position at which the transferring bias is changed.
Figure 14:
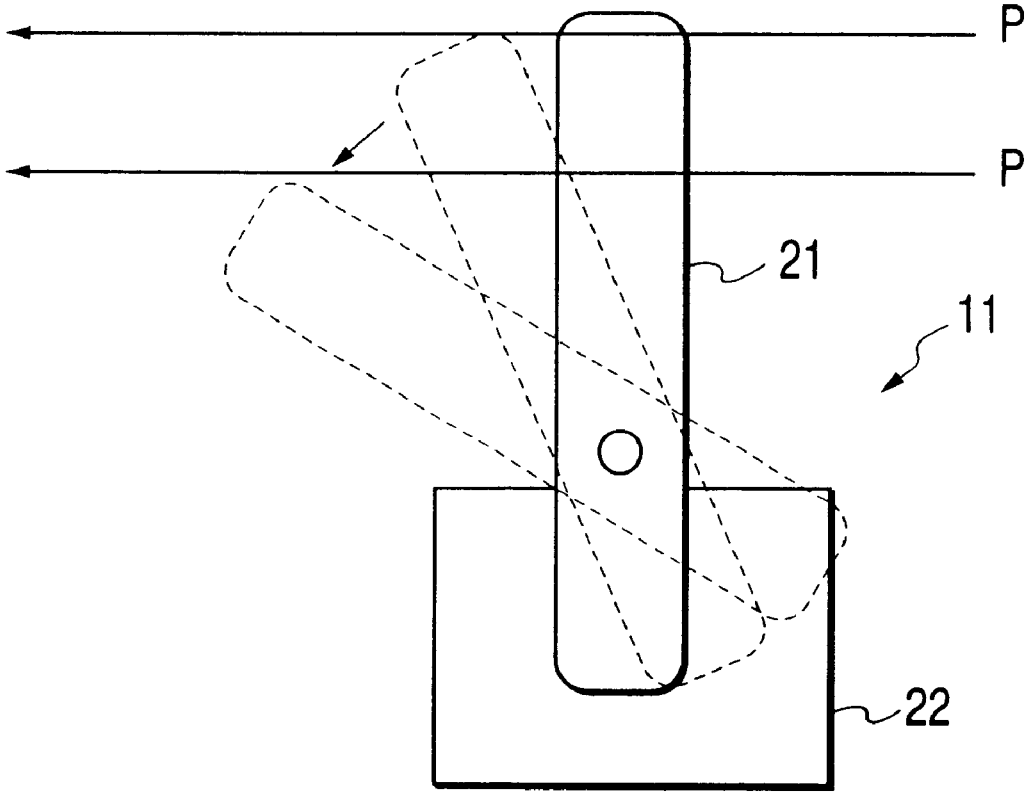
FIG. 14 is a diagram showing the structure of a top sensor.

Now, a description will be given in more detail of the preferred embodiments of the present invention with reference to the accompanying drawings. The overall construction is the same as that of FIG. 11 so that the explanation thereof will be omitted.

(First Embodiment)

Figure 1:
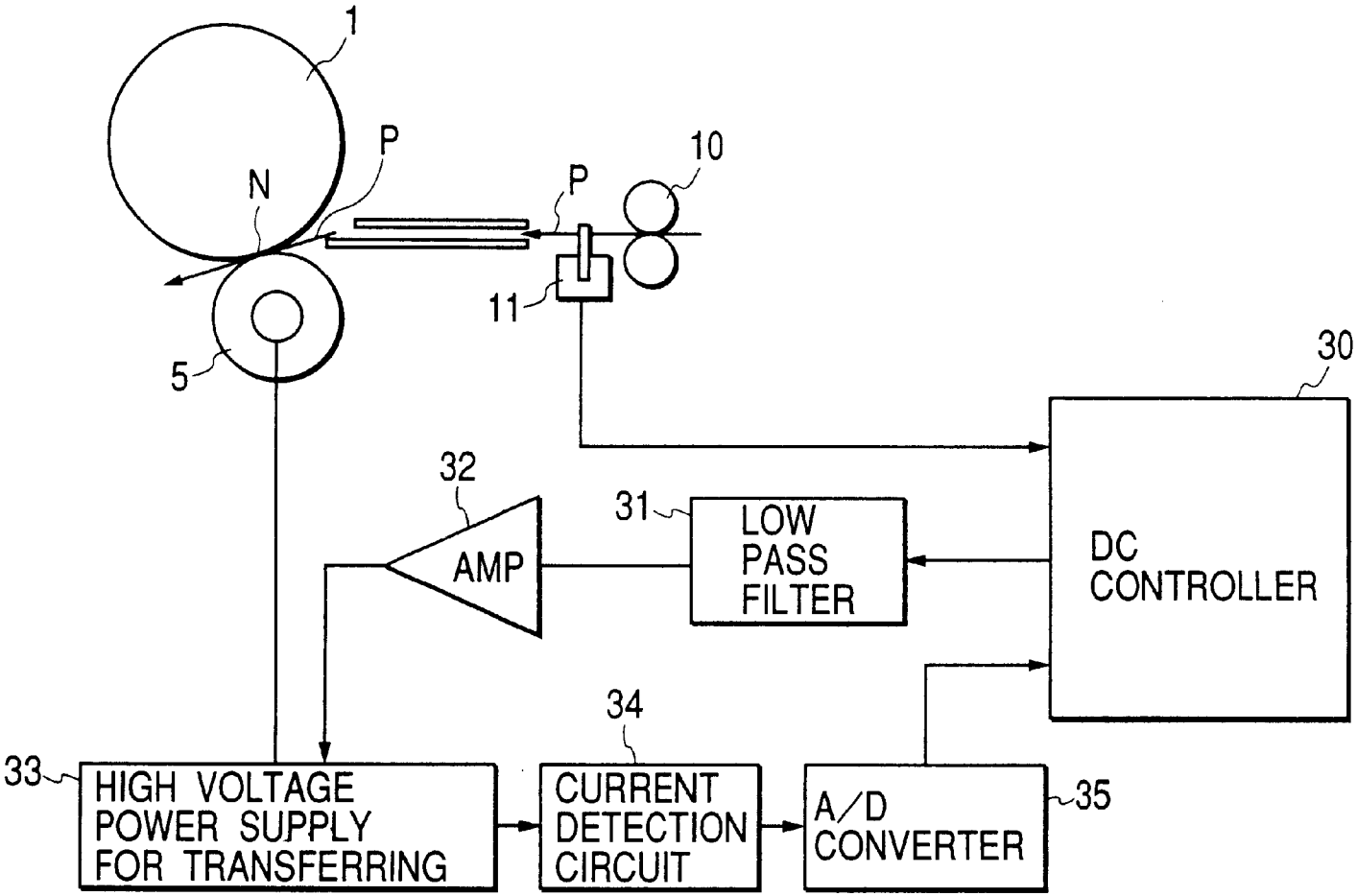
FIG. 1 is a schematic structural diagram showing a transferring bias control system of an image forming apparatus in accordance with a first embodiment of the present invention.
Figure 2:
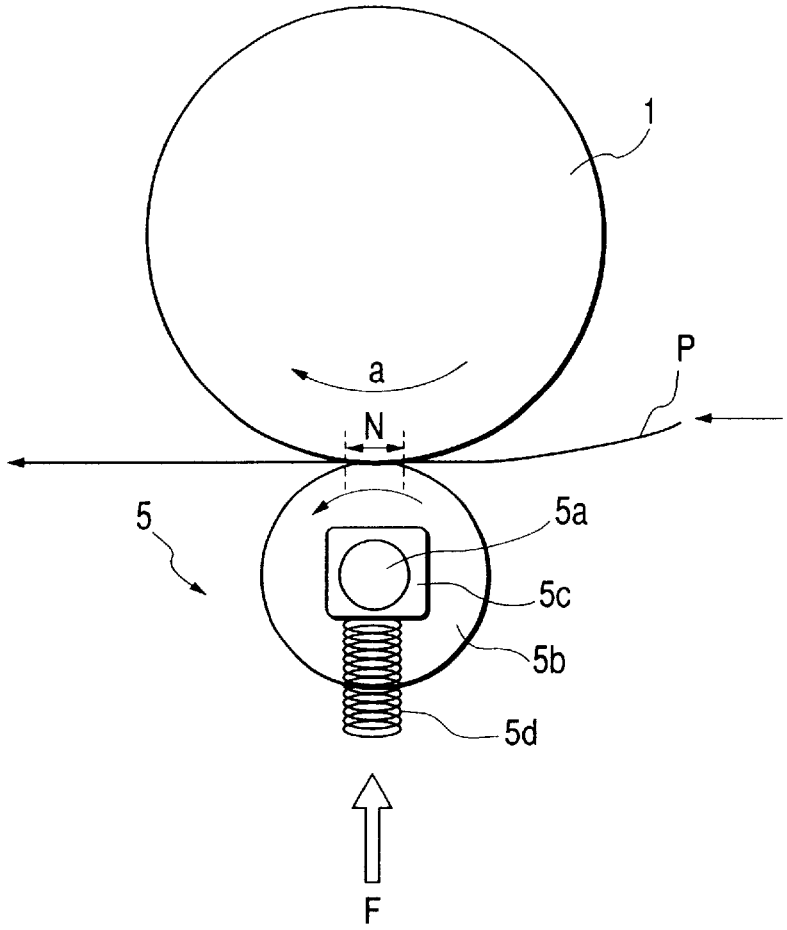
FIG. 2 is a side view showing a transferring nip portion between a photosensitive drum and a transfer roller in the image forming apparatus in accordance with the first embodiment of the present invention.
Figure 3:
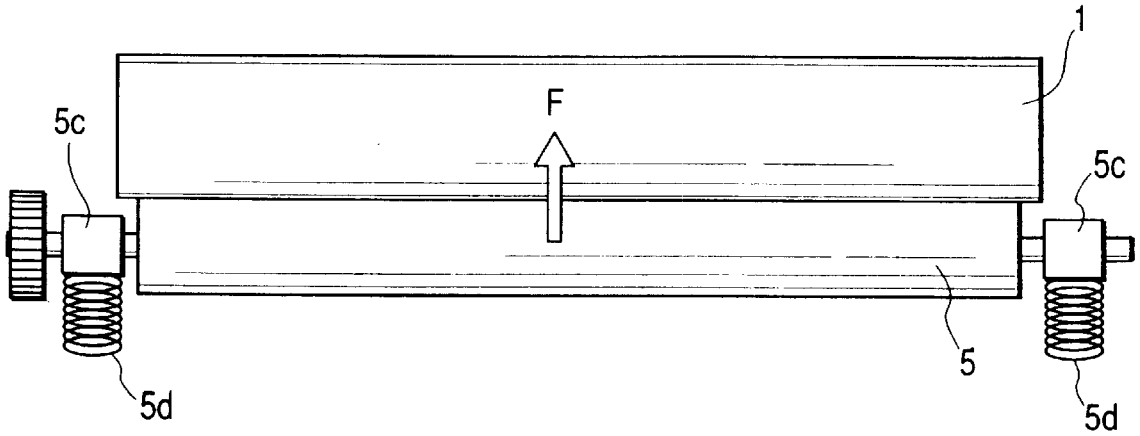
FIG. 3 is a front view showing the transferring nip portion between the photosensitive drum and the transfer roller in the image forming apparatus in accordance with the first embodiment of the present invention.

FIG. 1 is a schematic structural diagram showing a transferring bias control system of an image forming apparatus in accordance with a first embodiment of the present invention, FIG. 2 is a side view showing the vicinity of a transferring nip portion between a photosensitive drum and a transfer roller, and FIG. 3 is a front view showing the vicinity of the transferring nip portion between the photosensitive drum and the transfer roller.

In an image forming apparatus according to this embodiment, a transferring bias control is conducted by a PTVC control method which will be described below.

In the PTVC control method, when a pass signal of the transferring material P which is conveyed to the transferring nip portion N between the photosensitive drum 1 and the transfer roller 5 is inputted to a controller (DC controller) 30 from the top sensor 11, the controller 30 outputs a PWM signal having a pulse width corresponding to a desired transferring output voltage to a low pass filter 31. The pulse width of the PWM signal is stored in a transferring output table (not shown) within the controller 30 in advance.

The PWM signal is converted into d.c. by the low pass filter 31 and then amplified by an amplifier (AMP) 32 into the transferring output voltage Vt before being inputted to the high-voltage power supply 33 for transferring. The high-voltage power supply for transferring 33 applies the transferring voltage Vtr to the transfer roller 5 on the basis of the inputted transferring output voltage Vt. A current value 1t that flows in this state is detected by a current detection circuit 34, and a signal corresponding to the current value It is inputted to the controller 30 through an A/D convertor 35.

Then, in the case where the constant-voltage control is intended to be conducted, a PWM signal having the pulse width corresponding to a desired voltage value is outputted in accordance with a judgement from the table representative of relation of the PWM signal and the transferring output which is set within the controller 30 in advance.

Also, in the case where the constant-current control is intended to be conducted, the pulse width of the PWM signal from the controller 30 is gradually increased continuously until the signal inputted to the controller 30 becomes a value corresponding to a desired current value (a constant current value), and thereafter a voltage (pulse width) is allowed to follow a change in the current value to conduct the constant-current control.

Subsequently, the transferring bias control in this embodiment will be described.

At the time when the photosensitive drum 1 has been completely charged upon receiving an image forming signal (print signal) from a host computer (not shown), a PTVC detection is executed once in a state where the photosensitive drum 1 and the transfer roller 5 are directly abutted against each other. The PTVC detection is held within the controller 30 with the voltage value as Vto, which is obtained when the transferring current reaches a predetermined constant current value after the output voltage from the high-voltage power supply for transferring 33 is gradually raised. The transferring voltage Vtr applied at the time of transferring is decided on the basis of the detected voltage value Vto and the following transferring control expression which is stored in the controller 30 in advance.

$$Vtr=\alpha Vto+\beta \quad (1)$$

where Vto in the above expression (1) is a generated voltage generated when a driven detected current flows in the transfer roller 5 at the time of the PTVC detection, and $\alpha$ and $\beta$ are constants arbitrarily decided in accordance with the transferring system.

After the decision of the transferring voltage Vtr, the printing operation starts at the time when a preparation for image formation has been completed, and the transferring material P is fed to the transferring nip portion N between the photosensitive drum 1 and the transfer roller 5 in synchronism with the toner image on the photosensitive drum 1. The synchronization of the transferring material P with the toner image on the photosensitive drum 1 is conducted by timer-count after the transferring material P passes through the top sensor 11, and the transferring voltage Vtr is constant-voltage applied to conduct the transferring operation simultaneously when the leading end of the transferring material P enters the transferring nip portion N.

Also, after the transferring material P has passed through the top sensor 11, the timer-count again starts, and a time at which the rear end of the transferring material P reaches the transferring nip portion N is reckoned backward. Then, the transferring bias Vtr is changed to a low transferring bias (paper-interval bias) Vlow which is applied at an interval (hereinafter referred to as "paper interval") between first and second conveyed transferring materials P a given period of time before the rear end of the transferring material P passes through the transferring nip portion N.

For example, assuming that a distance between the top sensor 11 and the transferring nip portion N is D (mm) and a process speed is S (mm/sec), a period of time T until the rear end of the transferring material P reaches the transferring nip portion N since it passes through the top sensor 11 is T=D/S (sec), and in the case where the transferring bias is intended to be changed to the low transferring bias at a position of c (mm) from the rear end of the transferring material P, the transferring bias is changed to the low transferring bias (D−c)/S (sec) after the rear end of the transferring material P passes through the top sensor 11.

In this embodiment, the transfer roller 5 is formed of a solid roller (packed texture) having a rubber such as EPDM, silicone, NBR or urethane formed around a mandrel 5*a* made of iron, SUS or the like, or a rubber roller having a foaming-sponge-like intermediate-resistant elastic layer 5*b*, as shown in FIGS. 2 and 3, and is in a range of 25 to 70 degrees in roller hardness (at the time of Asker-C/1 kg weight) and in a range of $10^6$ to $10^{10}$ Ω in resistance. The elastic layer 5*b* of the transfer roller 5 is secondarily vulcanized after first vulcanization and thereafter the surface of the elastic layer 5*b* is polished to make the outer diameter configuration in a desired dimension.

The transfer roller 5 used in this embodiment is formed of an electrically conductive and elastic roller manufactured in such a manner that the elastic layer (intermediate-resistant elastic layer) 5*b* made of an ion electrically conductive solid rubber of NBR which is $8\times10^7$ Ω in resistance is formed on the mandrel 5*a* which is made of Fe and 6 mm in diameter, and the roller hardness is set to 60 degrees (at the time of Asker-C/1000 g weight), the outer diameter is set to 16 mm, and the longitudinal dimension is set to 218 mm.

Also, the transfer roller 5 is brought in pressure contact with the photosensitive drum 1 by a pressure force F which is transmitted from both of longitudinal end portions of the mandrel 5*a* through a bearing 5*c* by a pressure spring 5*d*, to thereby form the transferring nip portion N. In this embodiment, the transfer roller 5 is brought in pressure contact with the photosensitive drum 1 by a total pressure 1 Kg.

Figure 4:
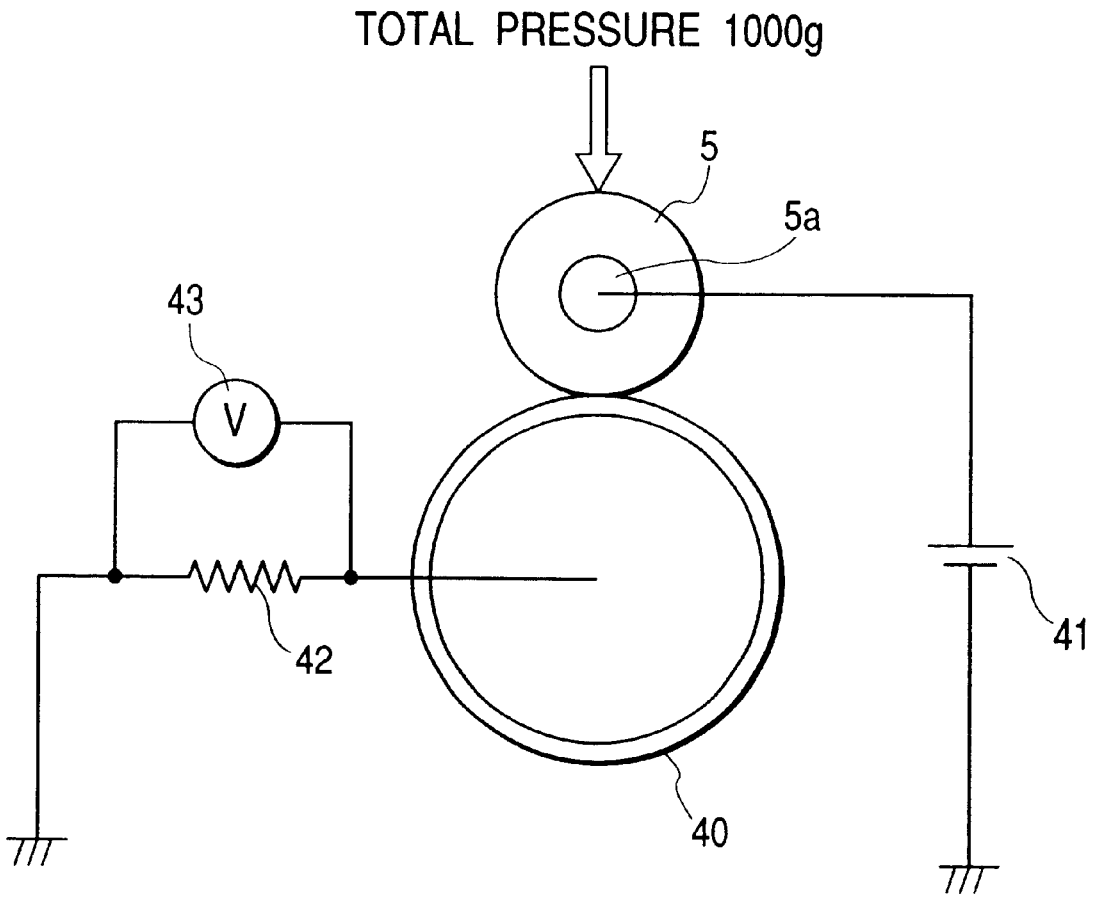
FIG. 4 is a diagram showing a method of measuring a resistance of the transfer roller.

FIG. 4 is a diagram showing a method of measuring a resistance of the transfer roller 5.

As shown in FIG. 4, the transfer roller 5 is abutted against an aluminum cylinder under a total pressure of 1000 g (500 g at one side) and rotated, and the maximum value and the minimum value of voltage values developed between both ends of a resistor 42 when an arbitrary voltage (for example, +2.0 KV) is applied to the mandrel 5*a* from a d.c. high voltage power supply 41 is read by a voltmeter 43. A mean value of the voltage values applied to the circuit is obtained from the read voltage value to calculate the resistance of the transfer roller 5. The measuring environments are that the temperature is 20° C. and the humidity is 60%.

Subsequently, the change of the transferring bias (changing from the transferring bias to the low transferring bias) under the transferring bias control in this embodiment will be described.

In this embodiment, the changing position of the transferring bias at the rear end of the transferring material P is decided in accordance with information as to one-side (front surface) print or double-sided (both surfaces) print (hereinafter referred to as "paper feed port information") with respect to the transferring material P which is conveyed to the transferring nip portion N.

As described above, the rear-end memory image remarkably occurs in the transferring material P which is low in resistance where a current is liable to concentratedly flow at the rear end of the transferring material P. Reversely, the scattering of the toner image at the rear end of the transferring material P is liable to occur in a state where the resistance of the transferring material P is high. Also, in case of the double-sided print (duplex image formation), the rear end memory image is liable to occur during the first printing whereas the toner image is liable to be scattered during the second printing.

The image forming apparatus according to this embodiment is structured so that the paper feed intervals are different depending on the designation of the sizes of the transferring material P. The rear end memory does not occur when the paper feed interval of the transferring material P becomes equal to or longer than one round length of the photosensitive drum 1 because a potential produced by a current flowing on the rear end of the transferring material P is attenuated. That is, the rear end memory occurs only when the paper feed interval is the one round length or shorter than the photosensitive drum 1.

Figure 5:
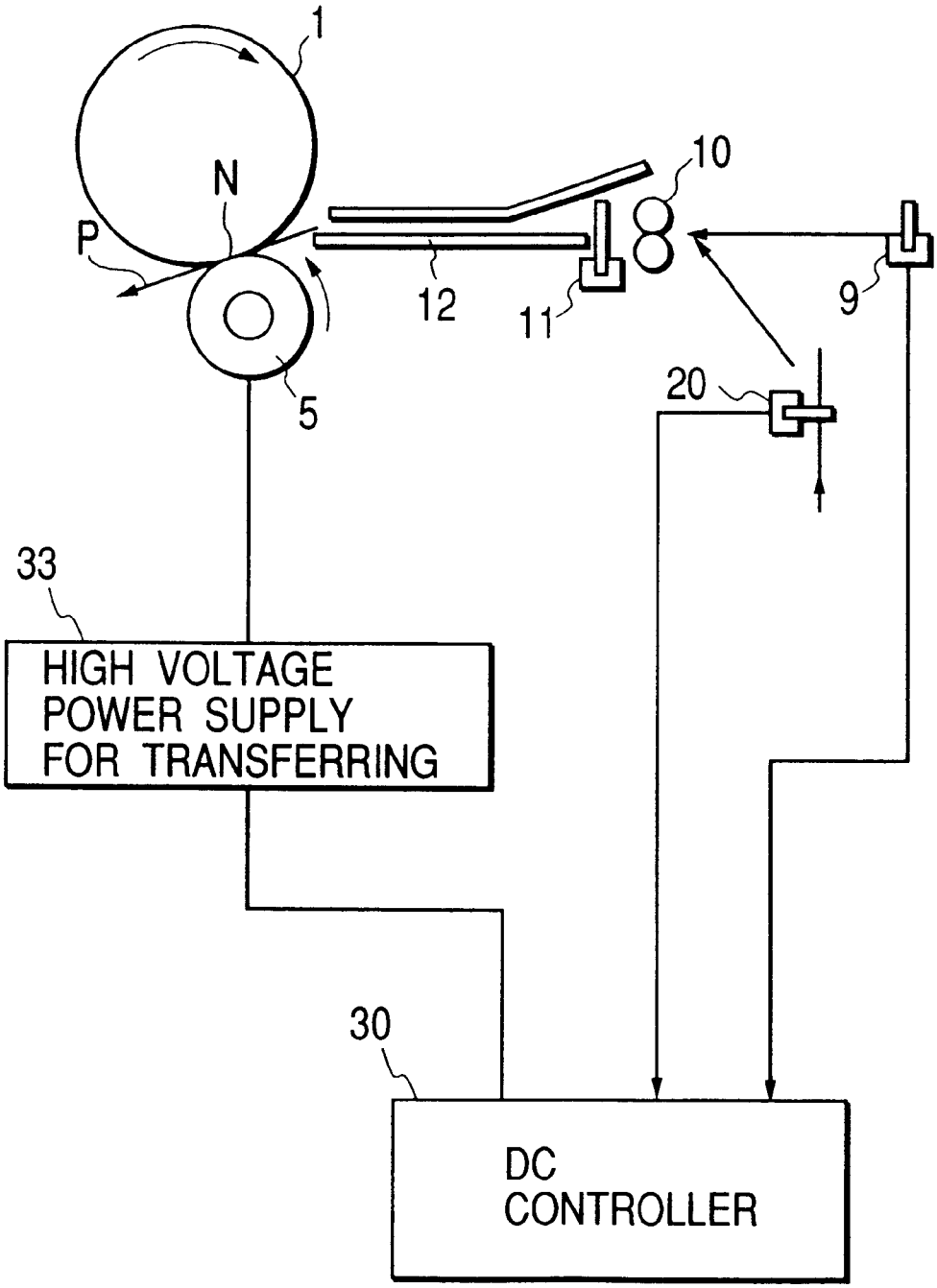
FIG. 5 is a schematic structural diagram showing the detection of a sheet feeding port in accordance with the first embodiment of the present invention.

In the image forming apparatus according to this embodiment, as shown in FIG. 5, the paper feed port information is detected by the pre-feed sensor 9 and the sheet re-feeding sensor 20, and the controller 30 judges that the first surface (the front surface) print is executed when the conveyance of the transferring material P is detected by the pre-feed sensor 9 and the second surface (the back surface) print in the duplex image forming operation is executed when the conveyance of the transferring material P is detected by the sheet re-feeding sensor 20.

Also, in the image forming apparatus according to this embodiment, the process speed is 100 mm/sec, A4/16 ppm, the paper interval at the time of continuous paper feeding is 50 mm, and a distance between the top sensor 11 and the transferring nip portion N is 75 mm. The transferring bias control is conducted by the above-described PTVC control, the transferring current that flows at the time of printing the first surface is about 6 μA, the transferring current that flows at the time of printing the second surface in the duplex image forming operation is about 5 μA, and the low transferring bias during the paper interval is 3 μA at the time of paper non-feeding under the control.

Then, in this embodiment, the transferring bias changing timing of from the transferring bias to the low transferring bias is set in accordance with the paper feed port information as shown in Table 1.

TABLE 1

| Paper Feed Port | Bias Changing Timing |
|---|---|
| MPT/Casette | Inside From Rear End 5 mm |
| Automatic Double-sided Paper Feed | Inside From Rear End 2 mm |

In the first-surface printing (in the case where the paper feed port is a multi-purpose tray (MPT) and a cassette paper feed), in order to suppress the occurrence of the rear end memory, the changing position (timing) of the transferring bias is set to 5 mm inside of the rear end of the transferring material P (the bias is changed 700 msec after the rear end of the transferring material P passes through the top sensor 11). Conversely, in the second-surface printing (automatic double-sided paper feed), in order to prevent the scattering of the toner image, the changing position of the transferring bias is set to 2 mm inside of the rear end of the transferring material P (the bias is changed 730 msec after the rear end of the transferring material P passes through the top sensor 11). The multi-purpose tray is a tray attached to the exterior.

Then, under the conditions where the rear end margin of the transferring material P is 5 mm in a normal humidity (humidity of 60%), at the time of one side (front surface) printing operation and automatic double-side (duplex) printing operation on a plain A4 size paper (75 g/m$^2$), the occurrence of the rear end memory and the occurrence of the scattering of the toner image (in this embodiment, the scattering of the toner image is called "image rear end explosion" or merely "explosion") were evaluated. Table 2 shows the evaluated results. In Table 2, comparative examples to this embodiment (1 in the figure) show examples in which the transferring bias was changed at a given timing regardless of the paper feed port. A comparative example 1 shows a case in which the transferring bias is changed at 2 mm inside of the rear end of the transferring material P whereas a comparative example 2 shows a case in which the transferring bias is changed at 5 mm inside of the rear end of the transferring material P.

TABLE 2

| | Print Side | Rear End Memory Frequency of Occurrence | Rear End Explosion Frequency of Occurence |
|---|---|---|---|
| Example 1 | One Side Print | 0/10 | 0/10 |
| | Automatic Double-sided Print | 0/10 | 0/10 |
| Comparative Example 1 | One Side Print | 9/10 | 0/10 |
| | Automatic Double-sided Print | 0/10 | 0/10 |
| Comparative Example 2 | One Side Print | 0/10 | 0/10 |
| | Automatic Double-sided Print | 0/10 | 5/10 |

In the comparative example 1, because the transferring bias changing point is set to 2 mm inside of the rear end of the transferring material P, the scattering of the toner image (image rear end explosion) does not occur even if the changing position is varied. Conversely, because the transferring bias changing position is in the vicinity of the rear end of the transferring material P, when the transferring material P passes through the transferring nip portion N during the one-side (front surface) printing operation, an excessive current flows with the result that the rear end memory occurs.

Also, in the comparative example 2, because the transferring bias changing point is set to 5 mm inside of the rear end of the transferring material P, the rear end memory does not occur even if the changing position is varied. However, if the transferring bias changing position is varied, because a voltage drops from the transferring bias Vtr to the low transferring bias Vlow within the image forming area (printing area) of the transferring material P, the transferring current is short during the second-surface printing operation where the resistance of the transferring material (paper) P is high with the result that the scattering of the toner image (image rear end explosion) occurs.

On the other hand, in this embodiment (embodiment 1), during the one-side (front surface) printing operation and at the time of printing the first surface during the double-sided (duplex) printing operation, where the rear end memory is liable to occur and the occurrence of scattering of the toner image (image rear end explosion) is difficult to occur, the bias changing is conducted at 5 mm inside of the rear end of the transferring material P. Then, at the time of printing the second-surface (back surface) during the double-sided (duplex) printing operation where because the resistance of the transferring material P is high, the current is concentrated at the rear end of the transferring material P and difficult to flow, and the rear end memory is difficult to occur, the transferring bias changing is conducted at 2 mm inside of the rear end of the transferring material P. As a result, in any of the cases, there are obtained an excellent image where both of the rear end memory and the scattering of the toner image (image rear end explosion) do not occur.

As described above, in this embodiment, since the changing position of the transferring bias at the rear end of the transferring material P is changed in accordance with the paper feed port (the one-side (front surface) print or the double-sided (duplex) print with respect to the transferring material P), the rear end memory and the scattering of the toner image (image rear end explosion) are prevented, thereby being capable of obtaining an excellent image.

(Second Embodiment)

A second embodiment will be described with reference to the image forming apparatus in the first embodiment. In the first embodiment, the changing position of the transferring bias at the rear end of the transferring material P is changed in accordance with the paper feed port (the one-side (front surface) print or the double-sided (duplex) print with respect to the transferring material P) information. On the other hand, in the second embodiment, the changing position of the transferring bias at the rear end of the transferring material P is changed in accordance with the resistance of the transferring material P and the resistance of the transfer roller 5. Other structures and image forming operation are identical with those in the first embodiment.

It has been found that the rear end memory and the scattering of the toner image described above are phenomenons occurring depending on the resistance of the transferring material P.

As described above, the rear end memory is caused by a current which concentratedly flows at the rear end of the transferring material P with respect to the photosensitive drum 1. The current that causes the rear end memory to occur is more liable to flow as the resistance of the transferring material P is lower, and the rear end memory is liable to occur. This phenomenon remarkably occurs particularly under the circumstances of a high humidity where the transferring material P absorbs moisture and its resistance is low.

On the other hand, the scattering of the toner image is liable to occur when the resistance of the transferring material P is high. This is because the unevenness of the transferred charges on the transferring material P which is produced during the transferring operation is not averaged at the transferring material P high in resistance due to the presence/absence of toner. In particular, for the above reason, the scattering of the toner image is liable to occur at the time of printing the second surface (back surface) during the double-sided (duplex) printing operation.

Under the above circumstance, in this embodiment, the transferring current that flows through the transferring material P during the transferring operation is detected to estimate the resistance of the transferring material P. If the resistance is high, the transferring bias changing position is set to be late whereas if the resistance is low, the transferring bias changing position is set to be early.

More specifically, in FIG. 1, the current value that flows in the photosensitive drum 1 through the transferring material P from the transfer roller 5 during the transferring operation is detected by the current detection circuit 34, and converted into a digital value by the A/D convertor 35. The digital value is inputted to the controller 30, and the resistance of the transferring material P is estimated from the current value that flows in the transferring roller 5 by the controller 30. In this situation, in order to more accurately detect the resistance of the transferring material P, in this embodiment, the above current detection is conducted in the margin area at the leading end of the transferring material P in the transferring material conveying direction when the transferring material P enters the transferring nip portion N, to thereby estimate the resistance of the transferring material P.

Figure 6:
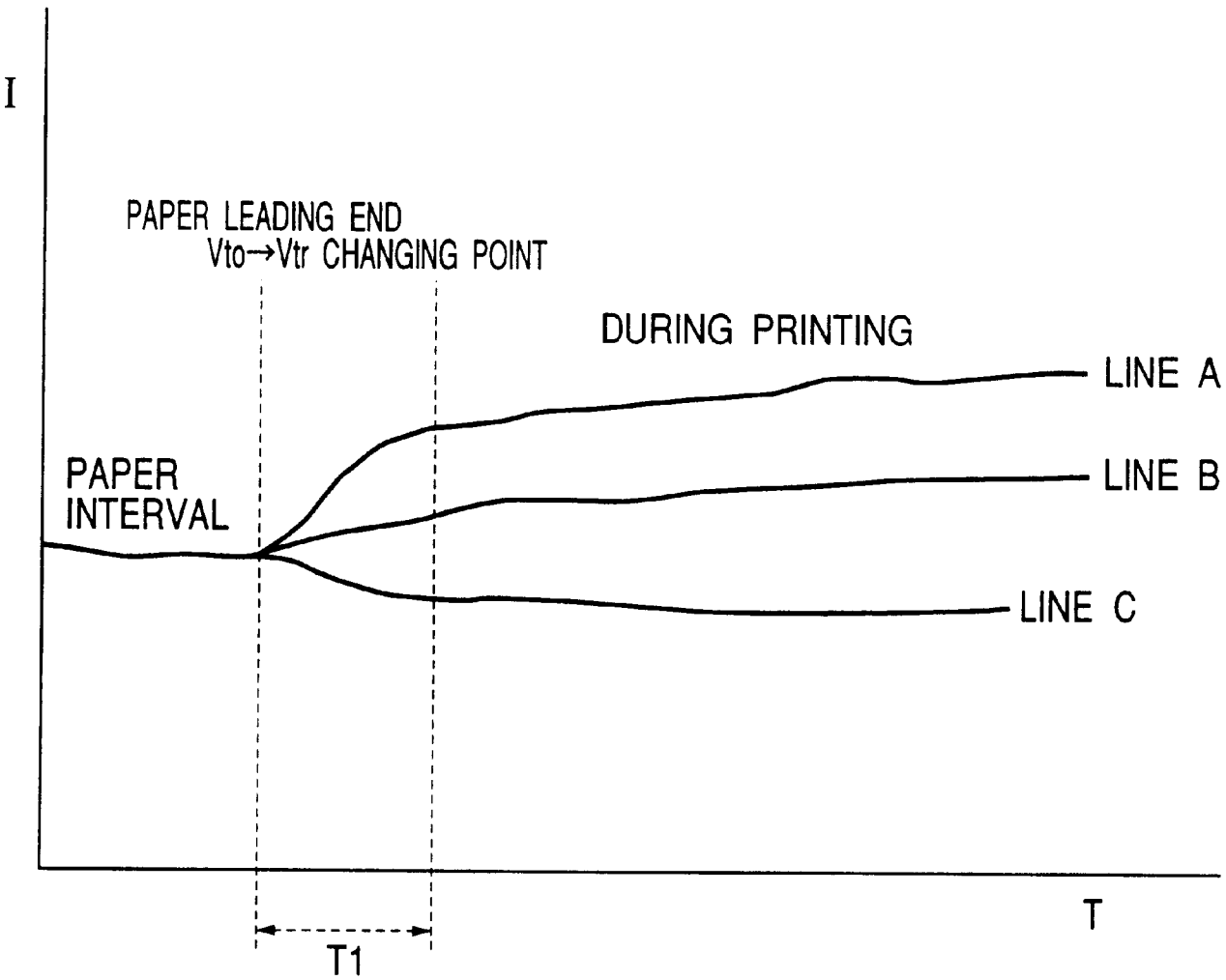
FIG. 6 is a graph showing a change in a transferring current value at a leading end of the transferring material when the transferring materials different in resistance is conveyed.

FIG. 6 is a graph showing a change in a transferring current value at a leading end of the transferring material P when the transferring materials P different in resistance is conveyed to the transferring nip portion N. The axis of ordinate is a time t whereas the axis of abscissa is a transferring current value I.

In this embodiment, the above-described transferring voltage Vtr at the time when the paper passes through the transferring nip portion N which is decided on the basis of the detected results of the PTVC is changed from the voltage Vto and then applied as a constant voltage at the leading end of the transferring material P. The transferring current that flows during the transferring operation changes depending on the resistance of the transferring material P. For that reason, as shown in FIG. 8, the transferring current value is large as indicated by a line A in a case where the transferring material P is low in resistance, and conversely the transferring current value becomes larger as indicated by a line C as the resistance of the transferring material P becomes higher. A line N is a transferring current value in the case where the resistance of the transferring material P is intermediate.

Also, the rear end memory is liable to occur because the current which concentratedly flows at the rear end of the transferring material P becomes larger as the transferring current value is larger, as described above. Conversely, the scattering of the toner image remarkably occurs because the transferring current becomes shorter at the transferring voltage changing position of the rear end of the transferring material P as the transferring current value is smaller.

Under the above circumstances, in this embodiment, the transferring current value while the leading end of the transferring material P passes through the transferring nip portion N is monitored by the controller 30 for a time T1, and the states of the transferring material P (the resistance, the hygroscopic state and the print side of the transferring material P) are totalized in accordance with the magnitude of the transferring current at that time, and then detected on the basis of the transferring current value. The controller 30 changes the transferring voltage changing position at the rear end of the transferring material P on the basis of the transferring current value thus detected.

Then, there were evaluated the transferring current value, the occurrence of the rear end memory and the occurrence of the toner image scatter (image rear end explosion) when the transferring materials different in resistance (low-resistant transferring material, plain paper and high-resistant transferring material) are subjected to one-side (front surface) print and automatic double-sided (duplex) print under the conditions of normal humidity (humidity of 60%), low humidity (humidity of 10%) and high humidity (humidity of 85%). Table 3 shows the evaluated results. The image forming apparatus and the transferring conditions in the evaluation are identical with those in the first embodiment.

The above results are exhibited in a case where the detection of the transferring current value is conducted at a portion where the leading end of the transferring material enters the transferring nip portion N by 4 mm, and the transferring bias changing position at the rear end of the transferring material P is 0 mm, 2 mm, 4 mm and 6 mm inside of the rear end of the transferring material P, respectively. Also, in this embodiment, a thin paper A4 in size (60 g/m$^2$) is used as a low-resistant paper, a recycled paper A4 is used as a high-resistant paper, and a transferring material A4 in size and 75 g/m$^2$ is used as a plain paper.

As is apparent from the evaluated results shown in Table 3, the transferring current value is higher as the humidity is higher because the transferring material P absorbs the moisture more, the transferring current value is lower as the humidity is lower because of no influence of humidity, and the transferring current value is an intermediate value therebetween in the normal humidity.

TABLE 3

| | | | Transferring | 0 mm | | 2 mm | | 4 mm | | 6 mm | |
|---|---|---|---|---|---|---|---|---|---|---|---|
| Environment | Transferring Material | Print Side | Current Value | Rear End Memory | Explosion | Rear End Memory | Explosion | Rear End Memory | Explosion | Rear End Memory | Explosion |
| High Humidity | Low Resistance | One Side | 8.5 μA | × | ○ | × | ○ | Δ | ○ | ○ | ○ |
| | | Double-Side | 5.5 μA | × | ○ | Δ | ○ | ○ | ○ | ○ | Δ× |
| | Plain Paper | One Side | 8 μA | × | ○ | × | ○ | Δ | ○ | ○ | ○ |
| | | Double-Side | 6.5 μA | × | ○ | Δ | ○ | ○ | ○ | ○ | Δ○ |
| | High Resistance | One Side | 6 μA | × | ○ | Δ | ○ | ○ | ○ | ○ | Δ |
| | | Double-Side | 4 μA | Δ | ○ | ○ | ○ | ○ | Δ | ○ | × |
| Normal Humidity | Low Resistance | One Side | 7 μA | × | ○ | Δ× | ○ | Δ | ○ | ○ | ○ |
| | | Double-Side | 4.5 μA | Δ | ○ | ○ | ○ | ○ | Δ | ○ | × |
| | Plain Paper | One Side | 6 μA | × | ○ | Δ | ○ | ○ | ○ | ○ | Δ |
| | | Double-Side | 4.5 μA | Δ | ○ | ○ | ○ | ○ | Δ | ○ | × |
| | High Resistance | One Side | 4 μA | Δ | ○ | ○ | ○ | ○ | Δ | ○ | × |
| | | Double-Side | 3.5 μA | Δ○ | ○ | ○ | ○ | ○ | × | ○ | × |
| Low | Low | One Side | 6 μA | × | ○ | Δ | ○ | ○ | ○ | ○ | Δ |

TABLE 3-continued

| | | | Transferring | 0 mm | | 2 mm | | 4 mm | | 6 mm | |
|---|---|---|---|---|---|---|---|---|---|---|---|
| Environment | Transferring Material | Print Side | Current Value | Rear End Memory | Explosion | Rear End Memory | Explosion | Rear End Memory | Explosion | Rear End Memory | Explosion |
| Humidity | Resistance | Double-Side | 4 μA | Δ | ○ | ○ | ○ | ○ | Δ | ○ | × |
| | Plain Paper | One Side | 5 μA | × | ○ | Δ | ○ | ○ | ○ | ○ | Δ× |
| | | Double-Side | 4 μA | Δ | ○ | ○ | ○ | ○ | Δ | ○ | × |
| | High Resistance | One Side | 3.5 μA | Δ○ | ○ | ○ | ○ | ○ | × | ○ | × |
| | | Double-Side | 3 μA | ○ | ○ | ○ | Δ | ○ | × | ○ | × |

○ : Excellent
Δ: Good
×: No-good

Then, an excellent image was obtained from the evaluated results shown in Table 3 by conducting the changing of the transferring bias from the transferring bias Vtr to the low transferring bias Vto at 0 mm from the rear end of the transferring material P, if the transferring current value is 3 μA or less as shown in Table 4, because the rear end memory does not occur and the scattering of the toner image (image rear end explosion) is liable to occur.

TABLE 4

| Transferring Current Value | Rear End Memory | Rear End Explosion | Rear End Off Timing |
|---|---|---|---|
| 3 μA or less | Exellent | Excellent if within 2 mm | 0 mm |
| From 3.5 to 5 μA | Excellent if 2 mm or more | Excellent if within 2 mm | Insdie 2 mm |
| From 5.5 to 6.5 μA | Excellent if 4 mm or more | Excellent if within 4 mm | Inside 4 mm |
| 7 μA or more | Excellent if 6 mm or more | Excellet | Inside 6 mm |

Also, because the rear end memory occurs more as the transferring current value increases more, and the scattering of the toner image (image rear end explosion) is less liable to occur, the optimum position of the transferring bias changing gradually enters inside from the rear end of the transferring material P. An excellent image was obtained by changing from the transferring bias Vtr to the low transferring bias Vto at 2 mm inside of the rear end of the transferring material P if the transferring current value is 3.5 to 5 μA, at 4 mm inside of the rear end of the transferring material P if the transferring current value is 5.5 to 6.5 μA, and at 6 mm inside of the rear end of the transferring material P if the transferring current value is 7 μA or more.

Figure 7:
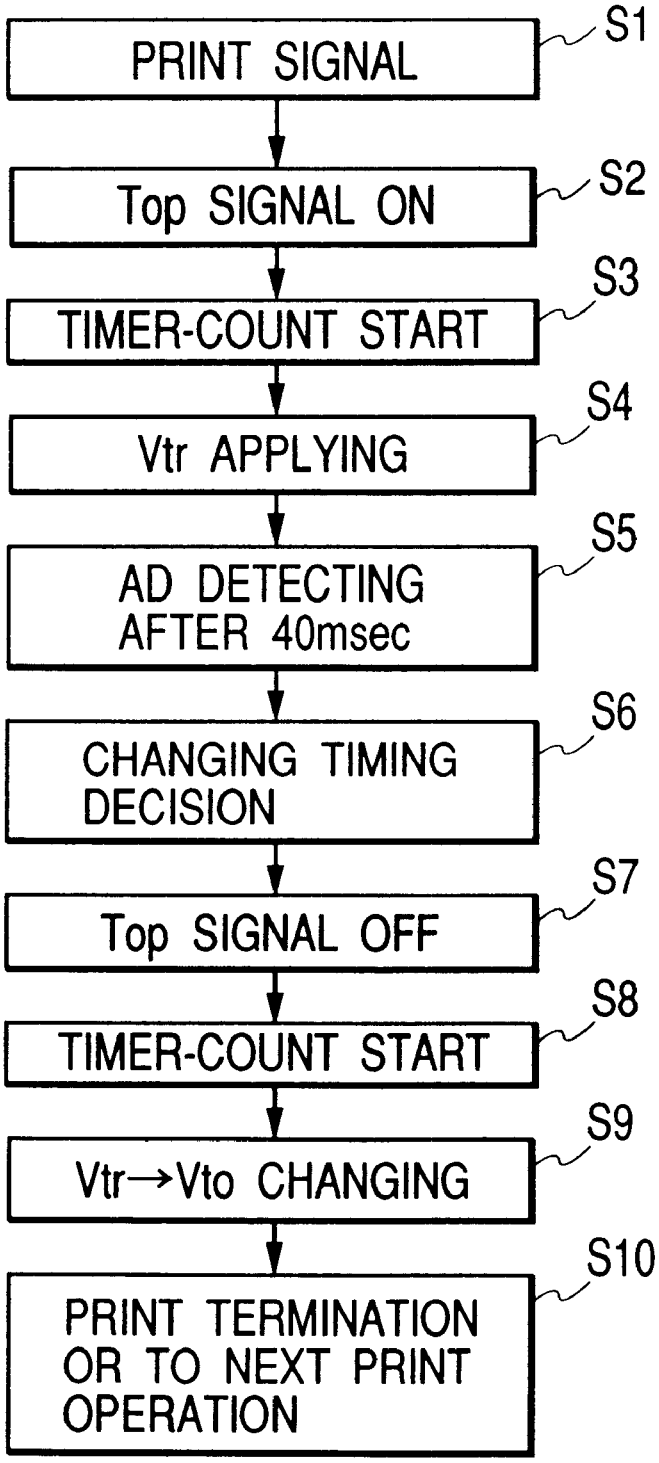
FIG. 7 is a flowchart showing a transferring bias changing control in accordance with a second embodiment of the present invention.

Subsequently, the above-described transferring bias changing control during the transferring operation in accordance with this embodiment will be described with reference to a flowchart shown in FIG. 7.

First, upon receiving a print signal from a host computer (not shown), printing (image forming) starts and paper feeding starts (step S1). Then, if the transferring material P passes through the top sensor 11 and a top signal is outputted (on) (step S2), the controller 30 starts timer-count (step S3), and the transferring bias Vtr is applied at the leading end of the transferring material P in synchronism with an image on the photosensitive drum 1 at the transferring nip portion N (step S4).

Then, the transferring current value (AD value) is detected 40 msec after the application of the transferring bias Vtr (corresponding to 4 mm from the leading end of the transferring material P at a process speed of 100 mm/sec) (step S5), and the controller 30 compares the inputted transferring current value (AD value) with a table prepared in advance to decide the transferring bias changing position (step S6).

Then, if the rear end of the transferring material P passes through the top sensor 11 to turn off the top signal (step S7), the controller 30 restarts the timer-count (step S8), estimates the rear end of the transferring material P at the transferring nip portion N, and changes from the transferring voltage Vtr to the low transferring bias Vto on the basis of the transferring bias changing position decided in the above manner (step S9). Then, the printing (image forming) operation is terminated, or the next printing (image forming) operation is continuously conducted (step S10).

The timer-count based on the top signal from the top sensor 10 slightly fluctuates. However, even if the transferring bias changing position is shifted from a set value because the time slightly fluctuates, the rear end memory and the scattering of the toner image which slightly occur fall within a level that does not cause any problem in practical use, and the results of actually printing the respective transferring materials used at the present time under the respective environments 50 sheets, respectively, were also excellent.

As described above, in this embodiment, the transferring current value that flows in the transferring material P is measured at the leading end of the transferring material P, and the transferring bias changing position at the rear end of the transferring material P is changed on the basis of the measurement, thereby being capable of preventing the rear end memory and the scattering of the toner image (image rear end explosion) to obtain an excellent image.

(Third Embodiment)

A third embodiment will be described with reference to the image forming apparatus in the first embodiment. In the third embodiment, a paper feed interval of the transferring materials P which are fed to the transferring nip portion N is monitored, and the changing position of the transferring bias at the rear end of the transferring material P is changed in accordance with the paper feed port information and the paper interval information.

Figure 8A:
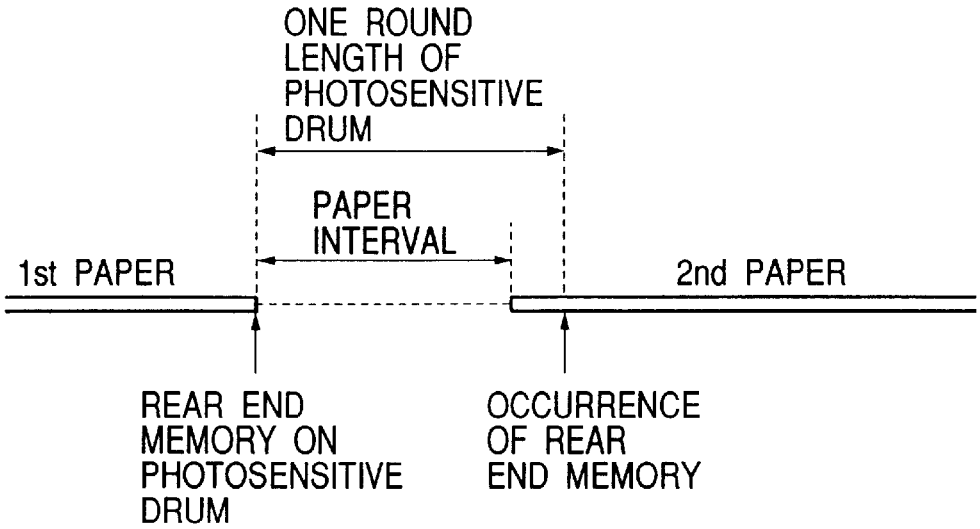
FIGS. 8A and 8B are diagrams for explanation of a paper interval and the occurrence of a rear end memory, respectively.
Figure 8B:
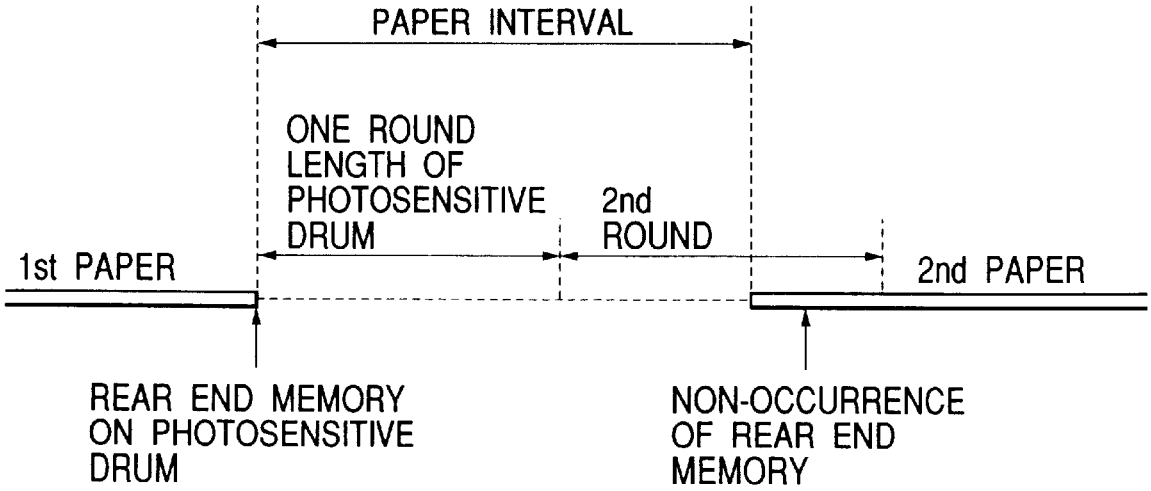

As was previously described, the rear end memory is a phenomenon in which, as shown in FIG. 8A, a memory produced on the photosensitive drum 1 by a current which concentratedly flows at the rear end of a first transferring material P occurs on a second transferring material P as a stripe image after the photosensitive drum 1 rotates one round. As shown in FIG. 8B, the memory on the photosensitive drum 1 is attenuated every time charging is repeated. Normally, the memory substantially disappears when printing is conducted in two rounds of the photosensitive drum 1, and the rear end memory does not appear on the image if the paper interval (an interval between the rear end of the first transferring material P and the leading end of the second transferring material P) is equal to or longer than one round of the photosensitive drum 1.

Accordingly, in this embodiment, the paper interval is judged from the paper feed interval, and the transferring bias changing position at the rear end of the transferring material P is changed between a case where the paper interval is equal to or longer than one round of the photosensitive drum 1 and a case where the paper interval is shorter than one round thereof. In this embodiment, the process speed of the image forming apparatus is set to 150 mm/sec, and other image forming conditions are identical with those in the first embodiment.

Assuming that the paper feed interval is T1 (sec), the size of the transferring material P (length) is M (mm) and the process speed is S (mm/sec), the paper interval T2 (sec) is obtained from the following expression.

$$T2=T1(M/S) \quad (2)$$

The controller 30 can judge the paper interval on the basis of the above expression (2).

Figure 9:
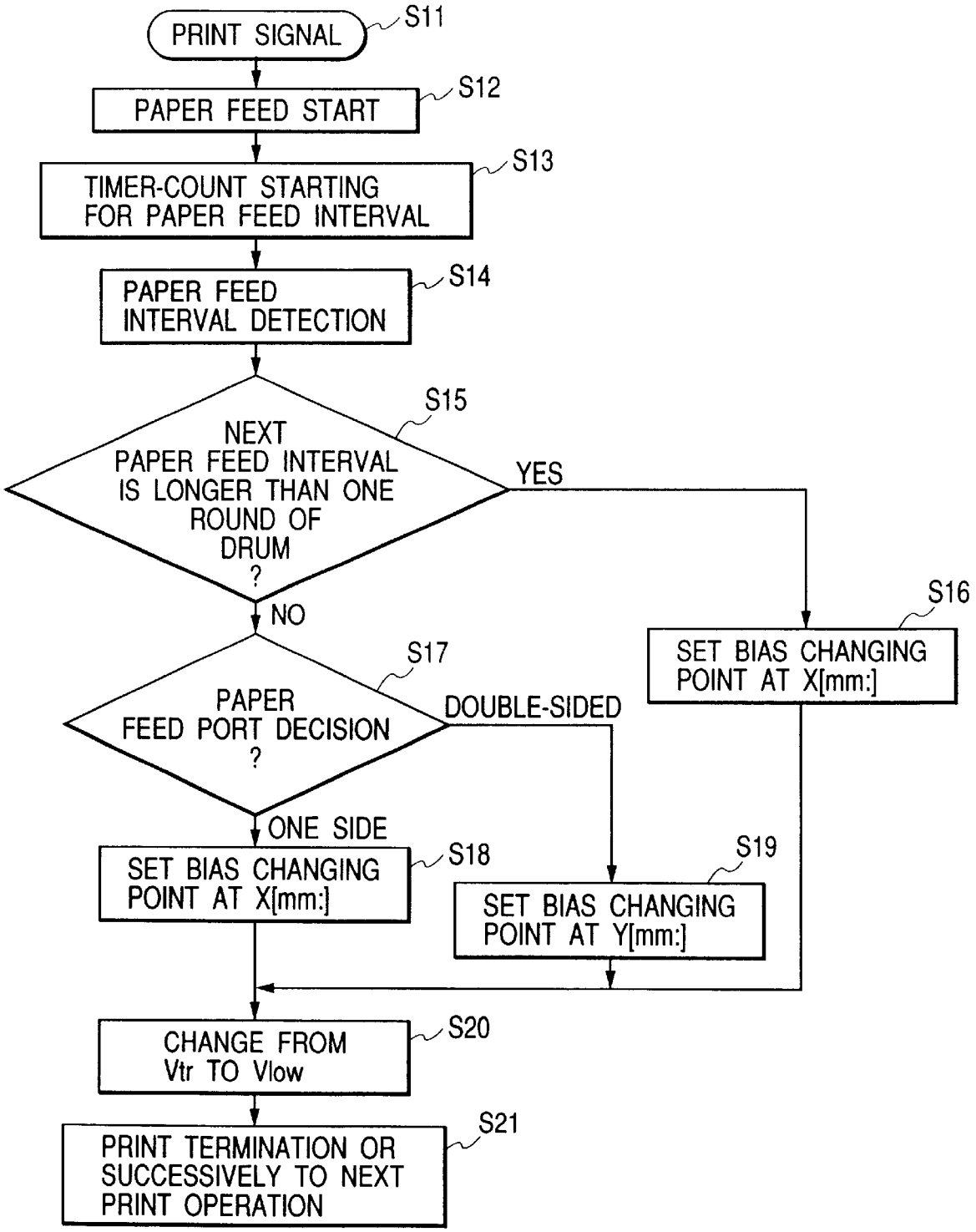
FIG. 9 is a flowchart showing a transferring bias changing control in accordance with a third embodiment of the present invention.

Subsequently, the transferring bias changing control in this embodiment will be described with reference to a flowchart shown in FIG. 9.

First, upon receiving a print signal from a host computer (not shown)(step S11), printing starts and paper feeding starts (step S12). In this situation, the controller 33 starts the timer-count of the paper feed interval on the basis of the pass signal of the (first) transferring material P which is inputted from the top sensor 11 (step S13).

Then, after the transferring material P is conveyed to the transferring nip portion N through the top sensor 11 in synchronism with an image on the photosensitive drum, if a next (second) transferring material P is conveyed, the paper feed interval between the previous (first) transferring material and the second transferring material is detected by the controller 33 (step S14).

The controller 33 judges the paper interval between the first and second transferring materials P according to the pass information of the transferring material P from the top sensor 11 (step S15), and if the paper interval is longer than one round of the photosensitive drum 1, the transferring bias changing position (changing point) at the rear end of the first transferring material P is set to X mm inside of the rear end of the transferring material P (step S16). X (mm) in step S16 is set to X=0 mm in this embodiment, that is, the rear end of the transferring material P.

In step S16, if the detected paper interval is shorter than one round of the photosensitive drum 1, the controller 33 judges from the inputted paper feed port information whether it is the one-side print (front surface print) or the double-sided print (back surface print in the duplex printing operation) (step S17). In case of the one-side print (front surface print) where the transferring material P is fed from the paper feed roller 8, the transferring bias changing position (point) is set to X mm inside of the rear end of the transferring material P (step S18). X (mm) in step S18 is set to 6 mm inside of the rear end of the transferring material P in this embodiment.

In step S17, in case of the double-sided print (back surface print in the duplex printing operation) where the transferring material P is fed from the paper re-feed roller 20, the transferring bias changing position (point) is set to Y mm inside of the rear end of the transferring material P (X>Y) (step S19). Y (mm) in step S19 is set to 2 mm inside of the rear end of the transferring material P in this embodiment.

Then, the transferring bias Vtr is changed to the low transferring bias (paper interval bias) Vlow in accordance with the transferring bias changing position set in steps S16, S18 and S19, respectively (step S20). Then, the printing (image forming) operation is terminated, or next printing (image forming) operation is continuously conducted (step S21).

As described above, in this embodiment, since the paper interval is calculated from the paper feed interval, and the transferring bias changing position is changed in accordance with the paper feed port information and the paper interval information, an excellent image can be obtained by preventing the rear end memory and the scattering of the toner even in the image forming apparatus high in process speed which make it difficult to adjust the transferring bias changing position.

(Fourth Embodiment)

A fourth embodiment will be described with reference to the image forming apparatus in the first embodiment. In the fourth embodiment, the changing position of the transferring bias at the rear end of the transferring material P is changed in accordance with the above-described paper feed port information and resistance of the transfer roller 5. In this embodiment, the process speed of the image forming apparatus is set to 150 mm/sec, and other image forming conditions are identical with those in the first embodiment.

In the first embodiment, in order to prevent both of the occurrences of the rear end memory and the toner scattering, the transferring bias changing position is set to inside of the rear end of the transferring material P only at the time of the one-side print (front surface print). However, in the environments of the low temperature and low humidity where the resistance of the transfer roller 5 becomes high, the transferring bias Vtr becomes a high voltage that exceeds 3 KV. If the transferring bias Vtr becomes high, when the transferring bias changes from the transferring bias Vtr to the low transferring bias Vlow, a predetermined period of time is required until the voltage becomes completely the low transferring bias Vlow due to the characteristics of a high-voltage circuit in the high-voltage power supply 33 for transferring.

For that reason, in the case where the transferring bias Vtr is high, in order to prevent the rear end memory, it is necessary that the transferring bias changing position is set to more inside of the rear end of the transferring material P than that in the first embodiment.

Figure 10:
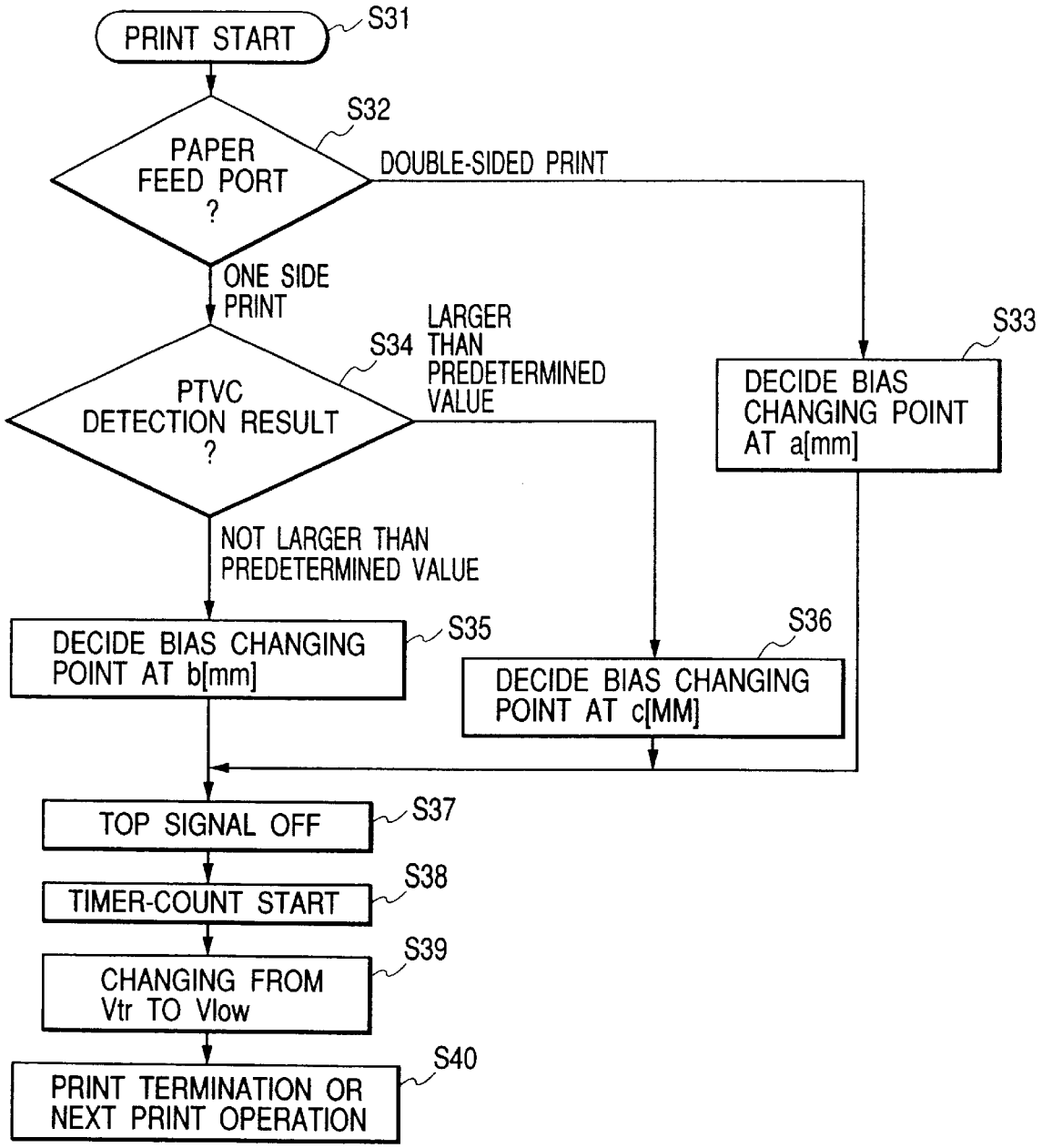
FIG. 10 is a flowchart showing a transferring bias changing control in accordance with a fourth embodiment of the present invention.

Subsequently, the transferring bias changing control in this embodiment will be described with reference to a flowchart shown in FIG. 10.

First, upon receiving a print signal from a host computer (not shown), printing (image formation) starts and paper feeding starts (step S31). In this situation, the controller 33 judges from the inputted paper feed port information whether it is the one-side print (front surface print) or the double-sided print (back surface print in the duplex printing operation) (step S32). In case of the double-sided print (back surface print during the double-sided printing operation) where the transferring material P is fed from the paper re-feed roller 20, in order to prevent the scattering of toner, the transferring bias changing position (point) is set to a mm inside of the rear end of the transferring material P (step S33).

Also, in step S32, at the time of the one-side print (front surface print) where the transferring material P is fed from the paper feed roller 8, if the detected value of PTVC is smaller than a predetermined value on the basis of the detected result of PTVC, it is judged that the transfer roller 5 is relatively low in resistance, and the transferring bias changing position (point) is set to b (a<b) mm inside of the rear end of the transferring material P (steps S34 and S35).

Also, in step S34, if the detected value of PTVC is equal to or larger than the predetermined value on the basis of the detected result of PTVC, it is judged that the transfer roller 5 is high in resistance, and the applied transferring bias is also high, the transferring bias changing position (point) is set to c (a<b<c) mm inside of the rear end of the transferring material P (step S36). In this embodiment, a is set to 2 (mm), b is set to 5 (mm) and c is set to 7 (mm).

After the transferring bias changing position has been decided in steps S33, S35 and S36, when the rear end of the transferring material P passes through the top sensor 11 to turn off the top signal (step S37), the controller 30 starts the timer-count (step S38), estimates the rear end of the transferring material P at the transferring nip portion N, and changes from the transferring voltage Vtr to the low transferring bias Vlow on the basis of the transferring bias changing position decided in the above manner (step S39). Then, the printing (image forming) operation is terminated, or the next printing (image forming) operation is continuously conducted (step S40).

As described above, in this embodiment, since the transferring bias changing position at the rear end of the transferring material P is changed in accordance with the paper feed port information and the resistance of the transfer roller 5, an excellent image can be obtained by preventing the rear end memory even in the case where the transfer bias is a high voltage.

The above description was given of the embodiments of the present invention, however, the present invention is not limited to those embodiments and can be modified within the technical concept of the invention.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus, comprising:

an image bearing member for bearing a toner image;

a transferring member for forming a nip with-said image bearing member and transferring the toner image onto a transfer material;

bias applying means for applying a transfer bias to said transfer member, said bias applying means changing from the transfer bias to a low bias lower than the transfer bias at the rear end portion of the transfer material; and control means for controlling so as to be able to change a changing position from the rear end of the transfer material, said changing position being a position for changing the transfer bias to the low bias.

2. The image forming apparatus as claimed in claim 1, wherein said control means changes the changing position to a rear end side of the transfer material if the transfer material is high in resistance.

3. The image forming apparatus as claimed in claim 2, further comprising fixing means for thermally fixing the transfer material to which the toner image is transferred, and re-feed means for re-feeding a back surface of the transfer material fixed by said fixing means to the nip toward said image bearing member side, wherein the changing position at the back surface is at a rear end side than the front surface.

4. The image forming apparatus as claimed in claim 2, further comprising current detecting means for detecting a current which flows when the leading end of the transfer material is nipped by the nip, wherein said control means controls the changing position on the basis of a detected output of said current detecting means.

5. The image forming apparatus as claimed in claim 4, wherein the leading portion of the transfer material which said current detecting means detects the current is a margin portion where no image is formed.

6. The image forming apparatus as claimed in claims 1, further comprising interval detecting means for detecting an interval between the transfer materials, wherein said control means controls the changing position on the basis of the detected output of said interval detecting means.

7. The image forming apparatus as claimed in claim 6, wherein if said interval detected by said interval detecting means is larger than a predetermined value, said control means changes the changing position to the rear end side of the transfer material.

8. The image forming apparatus as claimed in claim 1, further comprising deciding means for deciding the transfer bias, wherein said control means controls the changing position on the basis of the decided transfer bias value.

9. The image forming apparatus as claimed in claim 8, wherein if the decided transfer bias value is large, said control means changes the changing position to inside.

10. The image forming apparatus as claimed in claim 1, wherein said image bearing member has an OPC photosensitive member.

11. The image forming apparatus as claimed in claim 1, wherein said control means changes the changing position on the basis of information concerning the resistance of the transfer material.

* * * * *

UNITED STATES PATENT AND TRADEMARK OFFICE

CERTIFICATE OF CORRECTION

PATENT NO. : 6,449,444 B1
DATED : September 10, 2002
INVENTOR(S) : Yuko Tanaka

It is certified that error appears in the above-identified patent and that said Letters Patent is hereby corrected as shown below:

Column 2,
Line 2, "predetermied" should read -- predetermined --.

Column 5,
Line 16, "materials" should read -- material --.

Column 8,
Table 1, "Casette" should read -- Cassette --.

Column 9,
Table 2, "Occurrence" should read -- Occurrence --.

Column 10,
Line 32, "operation" should read -- operations --.

Column 11,
Line 16, "materials" should read -- material --.

Column 13,
Table 4: "Exellent" should read -- Excellent --; "Insdie" should read -- Inside --; and "Excellet" should read -- Excellent --.

UNITED STATES PATENT AND TRADEMARK OFFICE

CERTIFICATE OF CORRECTION

PATENT NO. : 6,449,444 B1
DATED : September 10, 2002
INVENTOR(S) : Yuko Tanaka

It is certified that error appears in the above-identified patent and that said Letters Patent is hereby corrected as shown below:

Column 17,
Line 57, "with-said" should read -- with said --.

Column 18,
Line 30, "which" should read -- with which --.
Line 33, "claims 1," should read -- claim 1, --.

Signed and Sealed this

Eighteenth Day of February, 2003

JAMES E. ROGAN
*Director of the United States Patent and Trademark Office*